United States Patent [19]

Jarrett

[11] 3,976,249

[45] Aug. 24, 1976

[54] FUEL INJECTION SYSTEMS FOR INTERNAL COMBUSTION ENGINES

[75] Inventor: Boaz Antony Jarrett, Sevenoaks, England

[73] Assignee: C.A.V. Limited, Birmingham, England

[22] Filed: Apr. 14, 1975

[21] Appl. No.: 567,686

Related U.S. Application Data

[63] Continuation of Ser. No. 469,557, May 13, 1974, abandoned.

[30] Foreign Application Priority Data

May 12, 1973 United Kingdom ..... 22720/73

[52] U.S. Cl. ..... 239/533; 239/91

[51] Int. Cl.[2] ..... B05B 1/30; F02M 47/00

[58] Field of Search ..... 239/87–91, 239/96, 533

[56] References Cited

UNITED STATES PATENTS

| | | | |
|---|---|---|---|
| 1,701,089 | 2/1929 | Von Salis | 239/533 UX |
| 2,420,550 | 5/1947 | Miller | 239/533 X |
| 2,788,246 | 4/1957 | Nichols | 239/533 X |
| 3,409,226 | 11/1968 | Steiger | 239/533 X |
| 3,633,823 | 1/1972 | Steiger | 239/533 X |
| 3,640,466 | 2/1972 | Steiger | 239/533 X |
| 3,658,249 | 4/1972 | Sharpe | 239/533 X |
| 3,669,360 | 6/1972 | Knight | 239/533 |
| 3,688,986 | 9/1972 | Guegan et al. | 239/533 X |

*Primary Examiner*—Robert S. Ward, Jr.
*Attorney, Agent, or Firm*—Olson, Trexler, Wolters, Bushnell & Fosse, Ltd.

[57] ABSTRACT

A fuel injection system for supplying fuel to an internal combustion engine includes a fuel injection nozzle having a fuel pressure operable valve member which is moved by fuel under pressure delivered by an injection pump to allow fuel to flow through an outlet to the engine. The system also includes a pump for applying a pressure to assist closure of the valve member, the fluid pressure being adjustable in accordance with the speed of the pump and the setting of a quantity control member which determines the amount of fuel supplied by the injection pump.

7 Claims, 2 Drawing Figures

FUEL INJECTION SYSTEMS FOR INTERNAL COMBUSTION ENGINES

This is a continuation of application Ser. No. 469,557, filed May 13, 1974, now abandoned.

This invention relates to fuel injection systems for supplying fuel to internal combustion engines, the system including an injection nozzle having a valve member which is resiliently loaded to a closed position, a fuel injection pump which during a delivery stroke supplies fuel to the injection nozzle to effect movement of the valve member to the open position thereby to permit fuel flow to a combustion space of an associated engine, the valve member also defining a surface which is exposed to a fluid pressure, the fluid pressure acting on said surface producing a force which assists the action of the resilient means, the fuel injection pump including a quantity control member whereby the amount of fuel supplied at each delivery stroke can be varied.

The object of the invention is to provide such a system in a simple and convenient form.

According to the invention, a system of the kind specified includes means for supplying said fluid pressure, and means operable to vary said fluid pressure so that at least in part it is dependent upon the setting of said quantity control member.

Figure 1:
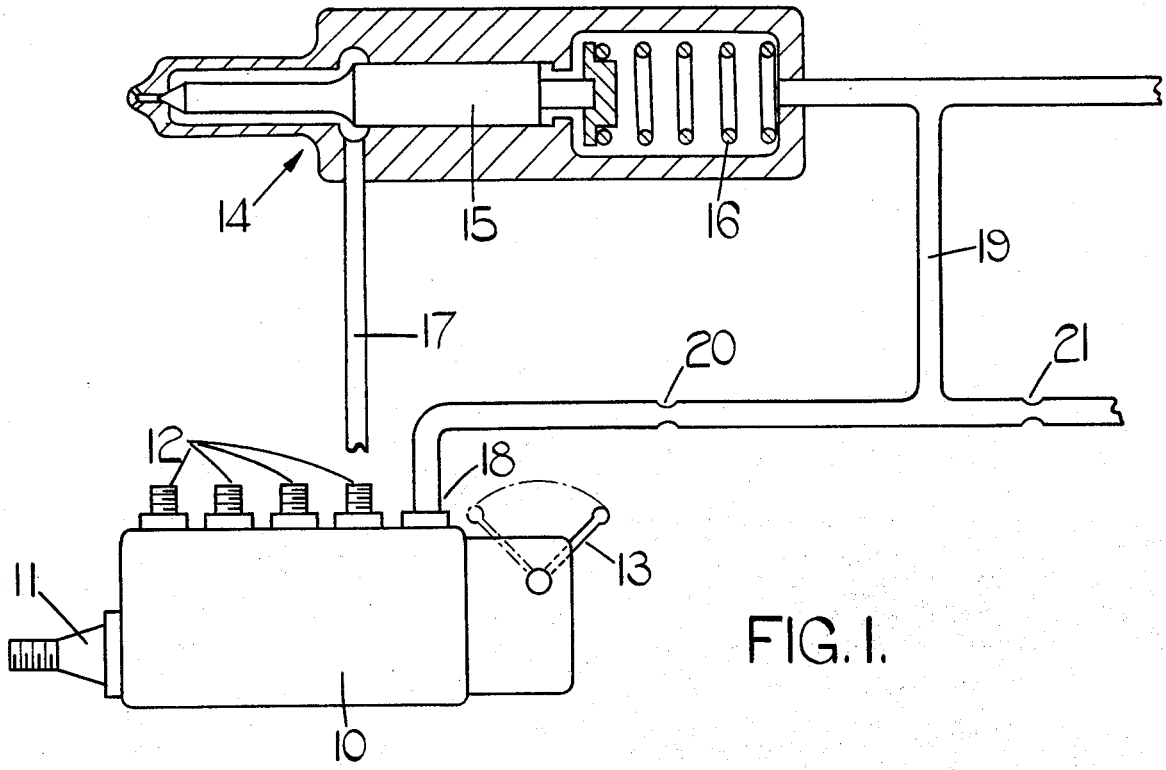
Figure 2:
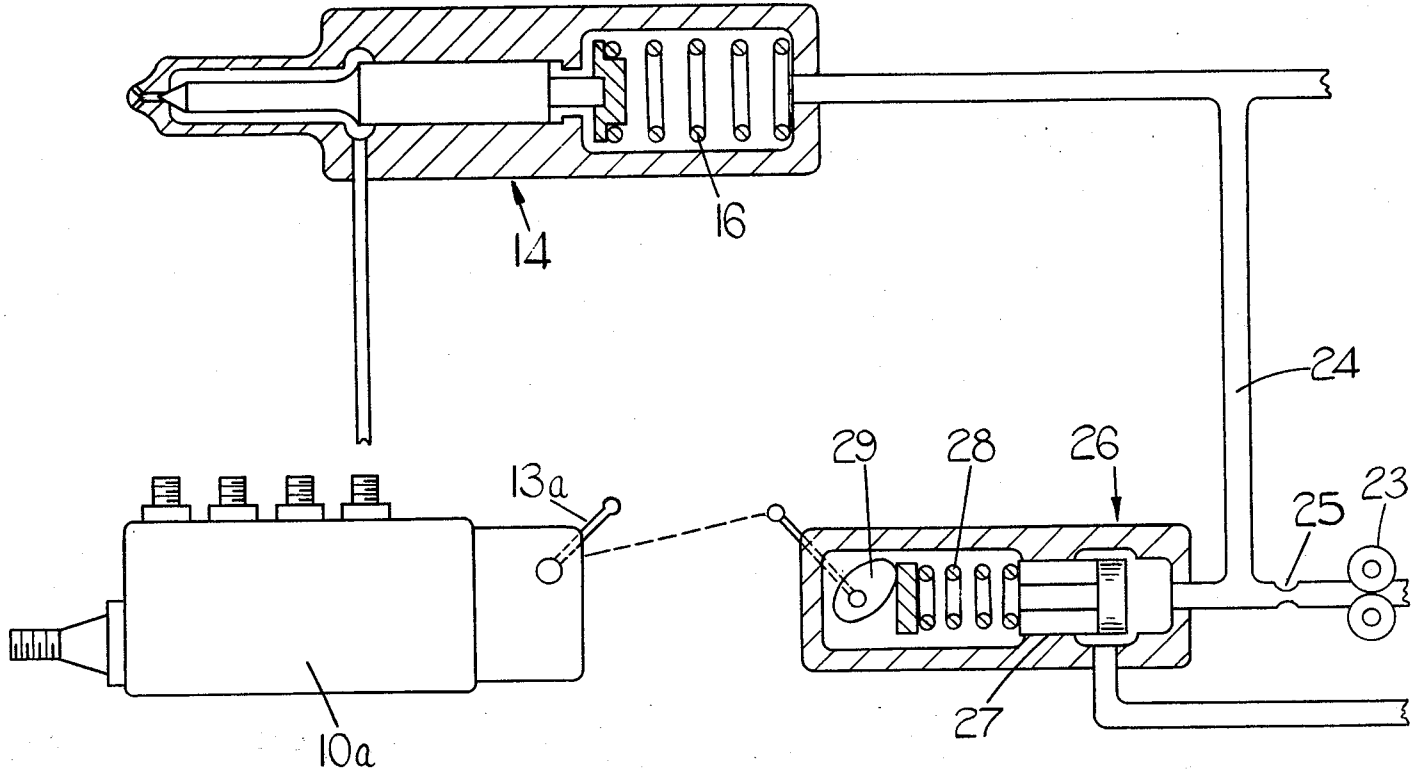

In the accompanying drawings:

FIG. 1 is an illustration of one example of a system in accordance with the invention, and FIG. 2 shows a further example.

Referring to FIG. 1 of the drawings, there is provided a fuel injection pumping apparatus 10 which is adapted to be driven in timed relationship with an associated engine by way of a drive shaft 11. The apparatus in the particular example comprises four individual reciprocating plunger injection pumps having outlets 12 respectively. The injection pumps are of conventional design and the amount of fuel delivered by each injection pump is controlled by a control member housed within the apparatus and connected to a governor mechanism. The governor mechanism includes an operator adjustable member 13, and depending upon the type of governor employed, the aforesaid control member will have a position dependent upon the selected speed in the case of an all speed governor, or a position dependent upon the load in the case of a two speed governor.

The system also includes four fuel injection nozzles 14 only one of which is shown. Each nozzle includes a valve member 15 which is resilienty loaded by means of a coiled compression spring 16, to a closed position. The valve member 15 is moved to an open position against the action of the spring 16 by fuel under pressure delivered by the respective injection pump, and for this purpose the outlet 12 of the respective injection pump is connected by way of a pipe line 17 to a chamber defined within the injection nozzle. In use, the fuel flowing through the pipe line 17 acts upon a surface of the valve member 15 to move it against the action of the spring 16. The valve member co-operates with a seating and when the valve member is lifted from the seating, fuel from the pipe line 17 can flow through an orifice into the respective combustion chamber.

The pumping apparatus 10 also includes an auxiliary pump having an outlet 18. The auxiliary pump may be identical in design to the injection pumps and in any event its output for each revolution of the apparatus is controlled by the aforesaid control member. The outlet 18 is connected by means of a pipe line 19 to the chamber in the injection nozzle which contains the spring 16. Branch pipelines are provided whereby all the chambers of the injection nozzles containing the springs 16 communicate with the outlet 18. Furthermore, interposed between the outlet 18 and the chambers is a restrictor 20 and downstream of the restrictor 20 is a passageway communicating with a drain and which contains a further restrictor 21.

The pressure within the chambers of the nozzles containing the springs 16 is dependent by virtue of the restrictors 20 and 21, upon the setting of the aforesaid control member. The pressure within the chamber will therefore vary in accordance with the speed, and the amount of fuel delivered by the auxiliary pump. The pressure in the chamber acts to assist the action of the spring 16 in moving the valve member towards the closed position.

In the arrangement which is shown in FIG. 2, the fuel injection pump 10*a* is of conventional construction and does not include the auxiliary pump. The fluid pressure which is supplied to the chamber containing the springs 16 of the injector 14 is derived from a pump 23, the output of which is connected by way of a pipe line 24 to the aforesaid chambers. Moreover, the pipe line 24 includes a restrictor 25 adjacent the outlet of the pump 23. The pump 23 may be drive by an electric motor, or it may be driven by the associated engine.

Downstream of the restrictor 25, there is positioned a control valve 26 and this includes a valve member 27 which can control the flow of fluid from downstream of the restrictor 25 back to the inlet of the pump 23. For this purpose the valve member 27 co-operates with an edge defined in a cylinder in which the valve element is located. The valve element is loaded by means of a coiled compression spring 28 towards a position to prevent the flow of fuel as mentioned and the force exerted by the spring 28 can be adjusted by means of a cam 29, the setting of which is controlled by the aforesaid control member of the injection pump 10*a*. It will be seen therefore that the fluid pressure within the chambers of the nozzles, which contain the springs is dependent upon the setting of the control member 13*a* of the injection pump, and the speed of rotation of the pump 23.

I claim:

1. In a fuel injection system having a fuel injection nozzle including valve means and pump means including an adjustable quantity control member for delivering fuel to said nozzle means for opening said valve means and dispensing fuel, the combination including means for supplying fluid pressure to said valve means for closing said valve means, and means responsive to said control member to vary said fluid pressure so that at least in part said fluid pressure is dependent upon the setting of said quantity control member.

2. A combination, as defined in claim 1, wherein said means for supplying fluid pressure comprises a pump for delivering fluid in accordance with the setting of the control member and the speed of operation of the pump, said pump having an outlet communicating with a drain by means of a pair of restrictors connected in series, and means directing said fluid pressure to said injection means' valve means from a point intermediate said restrictors.

3. A combination, as defined in claim 2, wherein said pump comprises a reciprocating plunger pump.

4. A combination, as defined in claim 1, wherein said means for supplying fluid pressure comprises a pump having an outlet, means including a restrictor connecting said pump outlet with said valve means, said means for supplying fluid pressure further comprising a valve adjustable to control said fluid pressure by allowing fluid to escape to a drain from downstream of said restrictor.

5. A combination, as defined in claim 4, in which said adjustable valve includes a spring biased valve element which is subjected to the fluid pressure downstream of said restrictor for being moved by said pressure against the action of the spring to permit escape of liquid, and means responsive to the setting of said control member for adjusting said spring.

6. A system comprising the combination defined in claim 1 and including a plurality of fuel injection nozzle means respectively including said valve means, a plurality of injection pumps respectively connected with said injection nozzle means, and the valve means of each of said nozzle means being connected with said fluid pressure supplying means.

7. A system including the combination defined in claim 4, a plurality of fuel injection nozzle means respectively including said valve means, a plurality of injection pump means for supplying fuel to said plurality of fuel injection nozzle means, the valve means of each of said nozzle means being connected with said means for supplying the fluid pressure.

* * * * *